US008132327B2

(12) United States Patent
Sieradzki

(10) Patent No.: US 8,132,327 B2
(45) Date of Patent: Mar. 13, 2012

(54) METHOD FOR MANUFACTURING A JEWELRY ITEM ENABLING A JEWELED BEARING TO BE HELD AND IMMOBILIZED

(75) Inventor: Arthur Sieradzki, Paris (FR)

(73) Assignee: Societe Sicom France (SARL), Paris (FR)

( * ) Notice: Subject to any disclaimer, the term of this patent is extended or adjusted under 35 U.S.C. 154(b) by 1126 days.

(21) Appl. No.: 11/578,852

(22) PCT Filed: Oct. 6, 2005

(86) PCT No.: PCT/FR2005/002459

§ 371 (c)(1),
(2), (4) Date: Oct. 19, 2006

(87) PCT Pub. No.: WO2006/045913

PCT Pub. Date: May 4, 2006

(65) Prior Publication Data

US 2007/0199346 A1 Aug. 30, 2007

(30) Foreign Application Priority Data

Oct. 25, 2004 (FR) ..... 04 11322

(51) Int. Cl.
*A44C 5/00* (2006.01)
*A44C 27/00* (2006.01)

(52) U.S. Cl. ..... 29/896.4; 29/896.41; 29/896.411; 29/896.43; 63/3; 63/3.1

(58) Field of Classification Search ..... 29/896.4, 29/896.41, 896.411, 896.43; 63/3, 33, 38, 63/3.1

See application file for complete search history.

(56) References Cited

U.S. PATENT DOCUMENTS

| | | | | |
|---|---|---|---|---|
| 3,864,181 | A * | 2/1975 | Wolinski et al. | 156/79 |
| 4,858,425 | A * | 8/1989 | Cheredaryk et al. | 59/80 |
| 5,155,990 | A * | 10/1992 | Poll | 59/80 |
| 5,454,234 | A * | 10/1995 | Karmeli | 63/28 |
| 7,036,338 | B2 * | 5/2006 | Hofer et al. | 63/3 |
| 2001/0045105 | A1 | 11/2001 | Takessian | |
| 2002/0092323 | A1 | 7/2002 | Lieberman | |

* cited by examiner

*Primary Examiner* — Alexander P Taousakis
(74) *Attorney, Agent, or Firm* — Ladas & Parry LLP

(57) ABSTRACT

A manufacturing device enabling jeweled bearings to be maintained, locked and immobilized on fishing line thread.

1 Claim, 2 Drawing Sheets

METHOD FOR MANUFACTURING A JEWELRY ITEM ENABLING A JEWELED BEARING TO BE HELD AND IMMOBILIZED

The present invention relates to a jewelry manufacturing device enabling all types (shapes and sizes) of bezels mounted with precious (or non-precious) stones to be held and immobilized on a material such as fishing line thread.

Usually, the jewel held by a fishing line thread is mounted in a traditional manner in place of a chain which passes inside a ring. This means the bezel (suspended by the ring) is made to slide from right to left on the fishing line thread.

The present invention offers a unique way of mounting the fishing line thread on the bezel or bezels of a jewel according to the compositions thereof, immobilizing the bezels and being joined to the fishing line thread. This invention allows all types of jewelry creation (pendants, earrings, bracelets, rings).

The device includes a bezel 1 mounted with a precious or non precious stone 4 and comprising a maximum of eight orifices 2 through which, according to the desired jewelry model, up to eight fishing line threads 3 are passed. The principle is to pass the fishing line thread 3 into one of the orifices of the bezel 1, then, using a welding iron, to carry out a spot weld (inside the bezel 1) on the end of the fishing line thread 3 in order to cause a swelling which immobilizes the bezel 1 (and, as a result, the fishing line thread 3). This process then has to be repeated for the desired orifices 2 as many times as necessary according to the model and composition of the jewel.

The attached drawings illustrate the invention:

Figure 1:
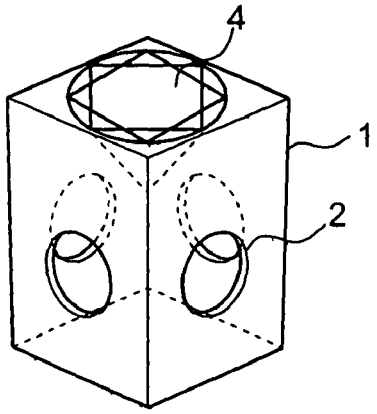
FIG. 1 shows an overall view.
Figure 2:
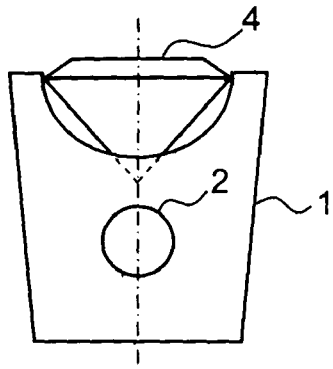
FIG. 2 shows a side view.
Figure 3:
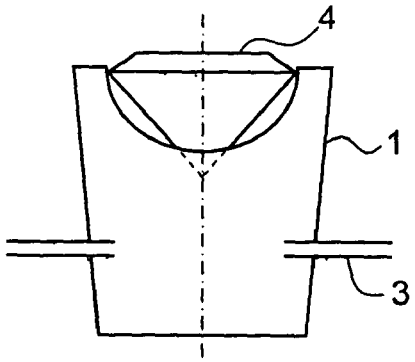
FIG. 3 shows an inside view before blockage.
Figure 4:
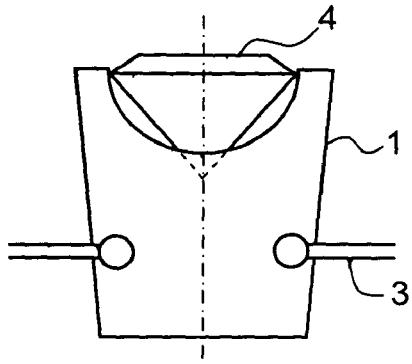
FIG. 4 shows an inside view after blockage.
Figure 5:
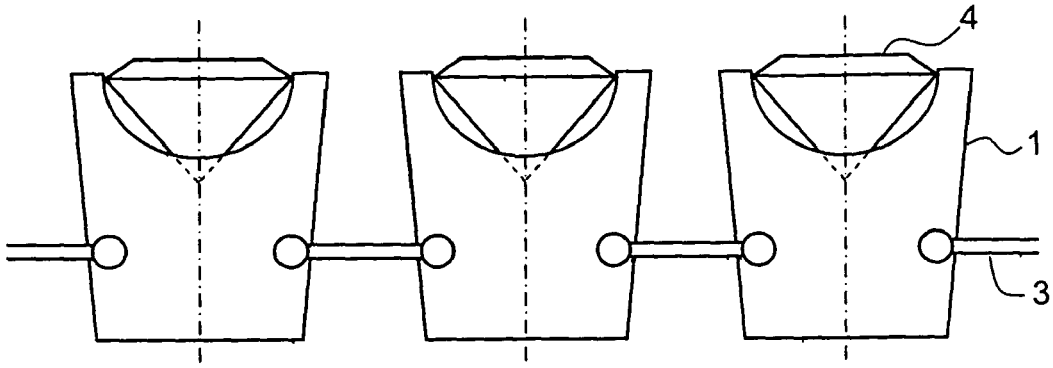
FIG. 5 shows a set of bezels connected together by fishing line thread.
Figure 6:
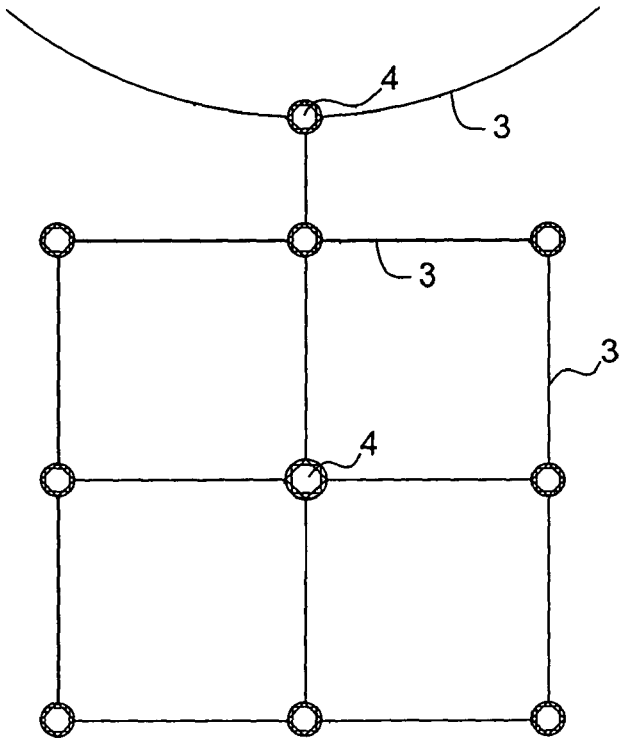
FIG. 6 shows an example of a composition jewel.

The invention claimed is:

1. A method for manufacturing a jewelry item enabling a bezel provided with orifices mounted with a precious or non-precious stone to be held and immobilized on a fishing line thread, the method comprising the steps of passing the fishing line thread into one of the orifices of the bezel, using a welding iron for carrying out a spot weld inside the bezel on an end of the fishing line thread, thereby creating a swelling at the end of the fishing line thread, thus blocking and immobilizing the bezel.

* * * * *